US010539350B2

(12) United States Patent
Knopp et al.

(10) Patent No.: US 10,539,350 B2
(45) Date of Patent: Jan. 21, 2020

(54) ECONOMIZER USED IN CHILLER SYSTEM

(71) Applicant: Daikin Applied Americas Inc., Minneapolis, MN (US)

(72) Inventors: Joseph Knopp, Staunton, VA (US); Naomasa Miki, Harrisonburg, VA (US); Paul Johnson, Waynesboro, VA (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 161 days.

(21) Appl. No.: 15/054,590

(22) Filed: Feb. 26, 2016

(65) Prior Publication Data

US 2017/0248355 A1 Aug. 31, 2017

(51) Int. Cl.

| | |
|---|---|
| ***F25B 43/00*** | (2006.01) |
| ***F25B 1/10*** | (2006.01) |
| ***F25B 31/02*** | (2006.01) |
| ***F25B 49/02*** | (2006.01) |
| ***F25B 1/053*** | (2006.01) |

(52) U.S. Cl.

CPC ..... *F25B 43/00* (2013.01); *F25B 1/053* (2013.01); *F25B 1/10* (2013.01); *F25B 31/026* (2013.01); *F25B 49/022* (2013.01); *F25B 49/025* (2013.01); *F25B 2400/02* (2013.01); *F25B 2400/13* (2013.01); *F25B 2400/23* (2013.01); *F25B 2600/2509* (2013.01); *F25B 2700/193* (2013.01)

(58) Field of Classification Search

CPC .. F25B 43/00; F25B 2400/23; F25B 2400/13; F25B 2400/02

See application file for complete search history.

(56) References Cited

U.S. PATENT DOCUMENTS 4,370,868 A * 2/1983 Kim ..... F25B 39/022 165/153
4,442,682 A * 4/1984 Sakata ..... F25B 11/02 415/203

(Continued)

FOREIGN PATENT DOCUMENTS

| | | | |
|---|---|---|---|
| GB | 2 180 922 | A | 4/1987 |
| JP | 2012-516773 | A | 7/2012 |
| WO | 2016/017601 | A1 | 2/2016 |

OTHER PUBLICATIONS

Xu et al., "Intermediate pressure of two-stage compression system under different conditions based on compressor coupling model", 2012.*

(Continued)

*Primary Examiner* — Nelson J Nieves

(74) *Attorney, Agent, or Firm* — Global IP Counselors, LLP

(57) ABSTRACT

An economizer includes a separation wheel, a motor, and a liquid storage portion. The separation wheel is arranged and configured to separate refrigerant into gas refrigerant and liquid refrigerant. The separation wheel is attached to a shaft rotatable about a rotation axis. The motor is arranged and configured to rotate the shaft in order to rotate the separation wheel. The liquid storage portion is arranged and configured to store the liquid refrigerant. The economizer is adapted to be used in a chiller system including a compressor, an evaporator and a condenser.

14 Claims, 10 Drawing Sheets

(56) References Cited

U.S. PATENT DOCUMENTS 4,509,341 A * 4/1985 Zimmern ..... F25B 1/04 62/500
4,690,759 A * 9/1987 Mandy ..... B01D 45/14 210/304
4,691,533 A * 9/1987 Zimmern ..... B04B 5/10 62/500
4,903,497 A 2/1990 Zimmern et al.
5,170,640 A * 12/1992 Heitmann ..... B01D 17/0214 55/337
5,271,245 A * 12/1993 Westermeyer ..... B01D 50/002 62/470
5,692,389 A * 12/1997 Lord ..... F25B 5/02 62/218
5,724,830 A * 3/1998 Otis ..... F25B 41/00 165/109.1
5,857,349 A * 1/1999 Hamaoka ..... F25B 49/025 62/158
7,484,374 B2 * 2/2009 Pham ..... F04C 29/042 62/324.1
7,891,201 B1 * 2/2011 Bush ..... F25B 1/10 62/115
8,574,451 B2 * 11/2013 Hulse ..... C09K 5/044 252/67
9,353,765 B2 * 5/2016 Haley ..... F04D 29/4213
9,415,335 B2 * 8/2016 Huff ..... F25B 1/10
9,669,346 B2 * 6/2017 Borkowski ..... B01D 45/08
2007/0074536 A1 * 4/2007 Bai ..... F25B 9/006 62/513
2010/0155017 A1 * 6/2010 Lemee ..... F25B 40/00 165/53
2010/0251750 A1 10/2010 Lifson et al.
2010/0326130 A1 12/2010 Takada et al.
2011/0056379 A1 * 3/2011 Lucas ..... B01D 45/12 96/216
2012/0151957 A1 * 6/2012 Kamiyama ..... F25B 43/006 62/430
2013/0104582 A1 * 5/2013 Sandkoetter ..... F25B 1/10 62/196.3
2013/0333402 A1 * 12/2013 Styles ..... B60H 1/3204 62/89
2014/0053597 A1 * 2/2014 Matsuura ..... F25B 1/00 62/510
2014/0208787 A1 * 7/2014 Furui ..... F25B 40/00 62/222
2014/0238067 A1 * 8/2014 Itou ..... F25B 41/04 62/324.6
2014/0260385 A1 9/2014 Umeda et al.
2014/0260388 A1 9/2014 Umeda et al.
2014/0290772 A1 * 10/2014 Itou ..... F25B 41/062 137/625.12
2014/0345307 A1 * 11/2014 Bagley ..... F25B 49/02 62/115
2015/0300713 A1 * 10/2015 Sun ..... F25B 49/02 62/115
2015/0362199 A1 * 12/2015 Yumoto ..... F25B 13/00 62/228.1
2016/0161163 A1 * 6/2016 Hung ..... F25B 13/00 62/205
2016/0313038 A1 * 10/2016 Young ..... F25B 43/02

OTHER PUBLICATIONS

The International Search Report for the corresponding International application No. PCT/US2017/019311, dated May 4, 2017.
International Preliminary Report on Patentability for the corresponding international application No. PCT/US2017/019311, dated Aug. 28, 2018.
International Preliminary Report on Patentability including Written Opinion for the corresponding international application No. PCT/US2017/019311, dated Aug. 28, 2018.

* cited by examiner

ECONOMIZER USED IN CHILLER SYSTEM

BACKGROUND

Field of the Invention

The present invention generally relates to an economizer used in a chiller system.

Background Information

A chiller system is a refrigerating machine or apparatus that removes heat from a medium. Commonly a liquid such as water is used as the medium and the chiller system operates in a vapor-compression refrigeration cycle. This liquid can then be circulated through a heat exchanger to cool air or equipment as required. As a necessary byproduct, refrigeration creates waste heat that must be exhausted to ambient or, for greater efficiency, recovered for heating purposes. A conventional chiller system often utilizes a centrifugal compressor, which is often referred to as a turbo compressor. Thus, such chiller systems can be referred to as turbo chillers. Alternatively, other types of compressors, e.g. a screw compressor, can be utilized.

In a conventional (turbo) chiller, refrigerant is compressed in the centrifugal compressor and sent to a heat exchanger in which heat exchange occurs between the refrigerant and a heat exchange medium (liquid). This heat exchanger is referred to as a condenser because the refrigerant condenses in this heat exchanger. As a result, heat is transferred to the medium (liquid) so that the medium is heated. Refrigerant exiting the condenser is expanded by an expansion valve and sent to another heat exchanger in which heat exchange occurs between the refrigerant and a heat exchange medium (liquid). This heat exchanger is referred to as an evaporator because refrigerant is heated (evaporated) in this heat exchanger. As a result, heat is transferred from the medium (liquid) to the refrigerant, and the liquid is chilled. The refrigerant from the evaporator is then returned to the centrifugal compressor and the cycle is repeated. The liquid utilized is often water.

A conventional centrifugal compressor basically includes a casing, an inlet guide vane, an impeller, a diffuser, a motor, various sensors and a controller. Refrigerant flows in order through the inlet guide vane, the impeller and the diffuser. Thus, the inlet guide vane is coupled to a gas intake port of the centrifugal compressor while the diffuser is coupled to a gas outlet port of the impeller. The inlet guide vane controls the flow rate of refrigerant gas into the impeller. The impeller increases the velocity of refrigerant gas. The diffuser works to transform the velocity of refrigerant gas (dynamic pressure), given by the impeller, into (static) pressure. The motor rotates the impeller. The controller controls the motor, the inlet guide vane and the expansion valve. In this manner, the refrigerant is compressed in a conventional centrifugal compressor.

In order to improve the efficiency of the chiller system, an economizer has been used. See for example U.S. Patent Application Publication No. 2010/0251750 and U.S. Pat. No. 4,903,497. The economizer separates refrigerant gas from two-phase (gas-liquid) refrigerant, and the refrigerant gas is introduced to an intermediate pressure portion of the compressor. As a conventional type of economizer, a flash tank economizer is well known in the art. See for example U.S. Patent Application Publication No. 2010/0326130.

SUMMARY

In a conventional flash tank economizer, a tank is provided for gas-liquid separation by gravity, and a floating valve is disposed inside the tank. In the conventional flash tank economizer, the refrigerant flow in the outlet of the tank is reduced by the valve disc of the floating valve so as to reduce the pressure of the refrigerant by the floating valve. While this technique works relatively well, this system requires a large tank to ensure dryness of the released gas and to avoid carryover by the refrigerant gas in droplet form, which results in increased costs. Also, the floating valve is often unstable, which makes the economizer system unreliable.

Also, in a conventional flash tank economizer, it is difficult to control the intermediate pressure of the compressor, and thus, a high coefficient of performance (COP) cannot be easily achieved. In addition, a conventional technique requires an economizer of a large diameter.

Therefore, one object of the present invention is to provide an economizer which is stable by using a separation wheel for gas-liquid separation without increased costs.

Another object of the present invention is to provide an economizer which achieves a high coefficient of performance (COP) by actively controlling the intermediate pressure of the compressor.

Yet another object of the present invention is to provide an economizer in which downsizing of the economizer diameter is achieved.

Yet another object of the present invention is to provide a chiller system which uses the economizer in accordance with the present invention.

One or more of the above objects can basically be attained by providing an economizer adapted to be used in a chiller system including a compressor, an evaporator and a condenser, the economizer including a separation wheel arranged and configured to separate refrigerant into gas refrigerant and liquid refrigerant, the separation wheel being attached to a shaft rotatable about a rotation axis, a motor arranged and configured to rotate the shaft in order to rotate the separation wheel, and a liquid storage portion arranged and configured to store the liquid refrigerant.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
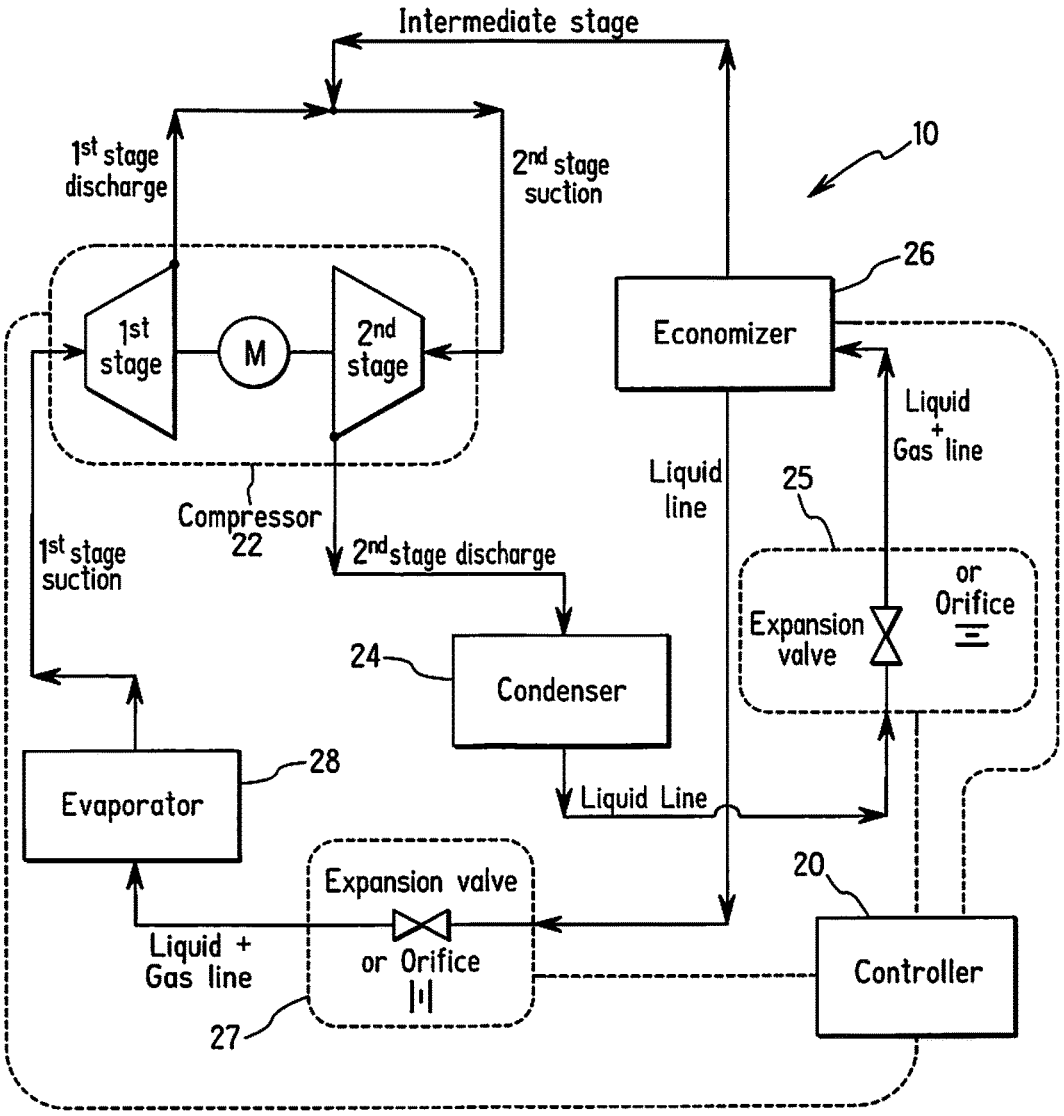
FIG. 1 illustrates a chiller system which includes an economizer in accordance with an embodiment of the present invention.

Referring initially to FIG. 1, a chiller system 10, which includes an economizer 26 in accordance with an embodiment of the present invention, is illustrated. The chiller system 10 is preferably a water chiller that utilizes cooling water and chiller water in a conventional manner. The chiller system 10 illustrated herein is a two-stage chiller system. However, it will be apparent to those skilled in the art from this disclosure that the chiller system 10 could be a single stage chiller system or a multiple stage chiller system including three or more stages.

The chiller system 10 basically includes a chiller controller 20, a compressor 22, a condenser 24, an economizer 26, expansion valves 25, 27, and an evaporator 28 connected together in series to form a loop refrigeration cycle. In addition, various sensors (not shown) are disposed throughout the circuit of the chiller system 10. The chiller system 10 may include orifices instead of the expansion valves 25, 27.

Figure 2:
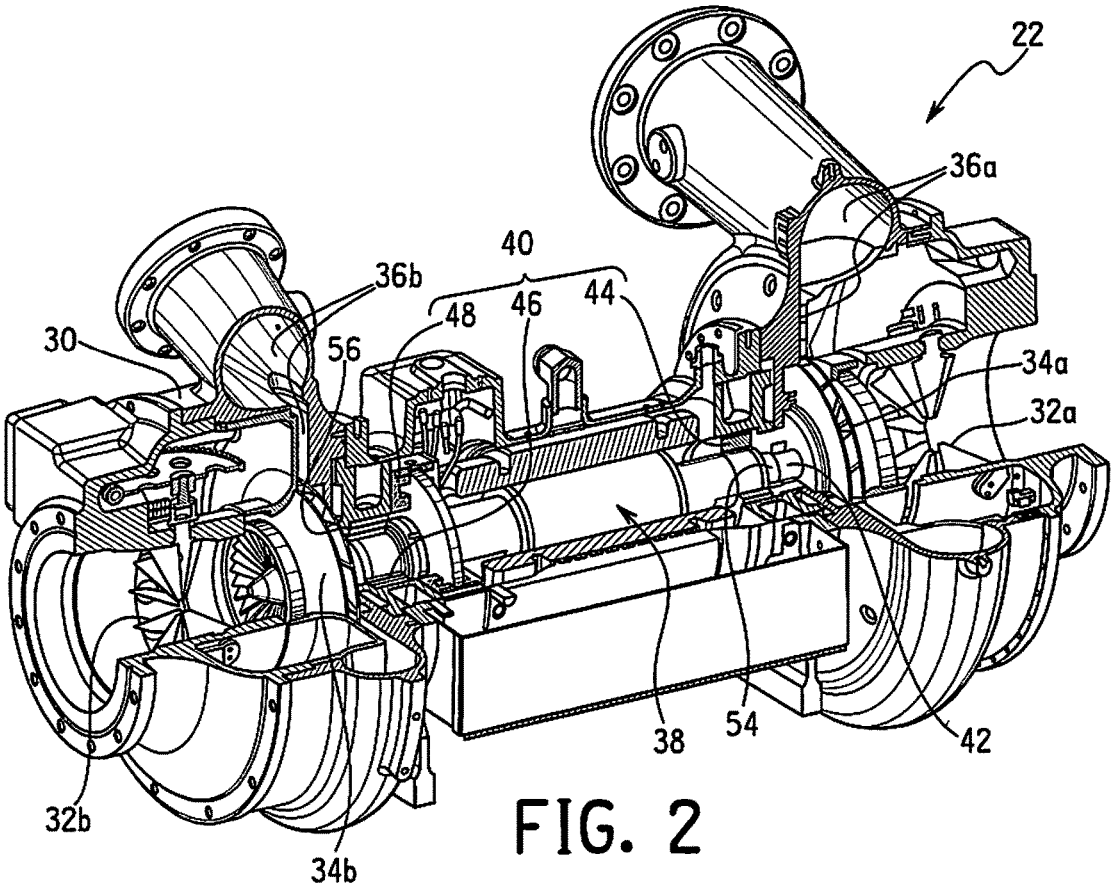
FIG. 2 is a perspective view of the centrifugal compressor of the chiller system illustrated in FIG. 1, with portions broken away and shown in cross-section for the purpose of illustration.
Figure 3:
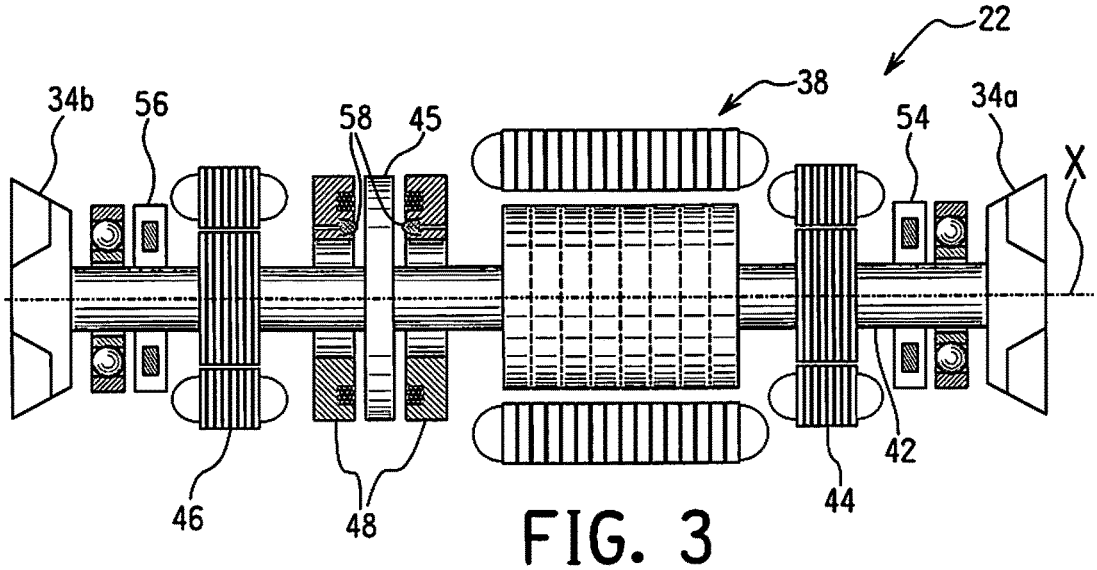
FIG. 3 is a schematic longitudinal cross-sectional view of the impeller, motor and magnetic bearing of the centrifugal compressor illustrated in FIG. 2.

Referring to FIGS. 1-3, the compressor 22 is a two-stage centrifugal compressor in the illustrated embodiment. The compressor 22 illustrated herein is a two-stage centrifugal compressor which includes two impellers. However, the compressor 22 can be a multiple stage centrifugal compressor including three or more impellers. Alternatively, the compressor 22 can be a screw compressor. The two-stage centrifugal compressor 22 of the illustrated embodiment includes a first stage impeller 34*a* and a second stage impeller 34*b*. The centrifugal compressor 22 further includes a first stage inlet guide vane 32*a*, a first diffuser/volute 36*a*, a second stage inlet guide vane 32*b*, a second diffuser/volute 36*b*, a compressor motor 38, and a magnetic bearing assembly 40 as well as various conventional sensors (only some shown).

The chiller controller 20 receives signals from the various sensors and controls the inlet guide vanes 32*a* and 32*b*, the compressor motor 38, and the magnetic bearing assembly 40 in a conventional manner, as explained in more detail below. Refrigerant flows in order through the first stage inlet guide vane 32*a*, the first stage impeller 34*a*, the second stage inlet guide vane 32*b*, and the second stage impeller 34*b*. The inlet guide vanes 32*a* and 32*b* control the flow rate of refrigerant gas into the impellers 34*a* and 34*b*, respectively, in a conventional manner. The impellers 34*a* and 34*b* increase the velocity of refrigerant gas, generally without changing pressure. The motor speed determines the amount of increase of the velocity of refrigerant gas. The diffusers/volutes 36*a* and 36*b* increase the refrigerant pressure. The diffusers/volutes 36*a* and 36*b* are non-movably fixed relative to a compressor casing 30. The compressor motor 38 rotates the impellers 34*a* and 34*b* via a shaft 42. The magnetic bearing assembly 40 magnetically supports the shaft 42. Alternatively, the bearing system may include a roller element, a hydrodynamic bearing, a hydrostatic bearing, and/or a magnetic bearing, or any combination of these. In this manner, the refrigerant is compressed in the centrifugal compressor 22.

In operation of the chiller system 10, the first stage impeller 34*a* and the second stage impeller 34*b* of the compressor 22 are rotated, and the refrigerant of low pressure in the chiller system 10 is sucked by the first stage impeller 34*a*. The flow rate of the refrigerant is adjusted by the inlet guide vane 32*a*. The refrigerant sucked by the first stage impeller 34*a* is compressed to intermediate pressure, the refrigerant pressure is increased by the first diffuser/volute 36*a*, and the refrigerant is then introduced to the second stage impeller 34*b*. The flow rate of the refrigerant is adjusted by the inlet guide vane 32*b*. The second stage impeller 34*b* compresses the refrigerant of intermediate pressure to high pressure, and the refrigerant pressure is increased by the second diffuser/volute 36*b*. The high pressure gas refrigerant is then discharged to the chiller system 10.

Referring to FIGS. 2 and 3, the magnetic bearing assembly 40 is conventional, and thus, will not be discussed and/or illustrated in detail herein, except as related to the present invention. Rather, it will be apparent to those skilled in the art that any suitable magnetic bearing can be used without departing from the present invention. The magnetic bearing assembly 40 preferably includes a first radial magnetic bearing 44, a second radial magnetic bearing 46 and an axial (thrust) magnetic bearing 48. In any case, at least one radial magnetic bearing 44 or 46 rotatably supports the shaft 42. The thrust magnetic bearing 48 supports the shaft 42 along a rotational axis X by acting on a thrust disk 45. The thrust magnetic bearing 48 includes the thrust disk 45 which is attached to the shaft 42.

The thrust disk 45 extends radially from the shaft 42 in a direction perpendicular to the rotational axis X, and is fixed relative to the shaft 42. A position of the shaft 42 along rotational axis X (an axial position) is controlled by an axial position of the thrust disk 45. The first and second radial magnetic bearings 44 and 46 are disposed on opposite axial ends of the compressor motor 38. Various sensors detect radial and axial positions of the shaft 42 relative to the magnetic bearings 44, 46 and 48, and send signals to the chiller controller 20 in a conventional manner. The chiller controller 20 then controls the electrical current sent to the magnetic bearings 44, 46 and 48 in a conventional manner to maintain the shaft 42 in the correct position.

The magnetic bearing assembly 40 is preferably a combination of active magnetic bearings 44, 46, and 48, which utilizes gap sensors 54, 56 and 58 to monitor shaft position and send signals indicative of shaft position to the chiller controller 20. Thus, each of the magnetic bearings 44, 46 and 48 are preferably active magnetic bearings. A magnetic bearing control section 71 uses this information to adjust the required current to a magnetic actuator to maintain proper rotor position both radially and axially.

As mentioned above, the chiller system 10 has the economizer 26 in accordance with the present invention. The economizer 26 is connected to an intermediate stage of the compressor 22 to inject gas refrigerant into the intermediate stage of the compressor 22, as explained in more detail below. In the chiller system 10, the economizer 26 is disposed between the evaporator 28 and the condenser 24.

The economizer 26 includes a separation wheel 62, an economizer motor 64, and a liquid storage portion 66 as shown in FIGS. 5-8. The separation wheel 62, the economizer motor 64, and the liquid storage portion 66 are disposed inside an economizer casing 60. The separation wheel 62 separates two-phase refrigerant into gas refrigerant and liquid refrigerant. The separation wheel 62 is attached to an economizer shaft 63 rotatable about a rotation axis. The economizer motor 64 rotates the economizer shaft 63 in order to rotate the separation wheel 62. In this manner, the separation wheel 62 separates the refrigerant into the gas refrigerant and the liquid refrigerant by dynamic force. The economizer 26 has its own motor, which allows scalability for various volume flow requirements. The economizer 26 further includes an economizer variable frequency drive 67. The economizer variable frequency drive 67 controls the economizer motor 64 in order to adjust a rotational speed of the separation wheel 62. The chiller controller 20 is programmed to execute an economizer control program as explained in more detail below to control the economizer variable frequency drive 67. The liquid storage portion 66 stores the liquid refrigerant separated from the two-phase refrigerant.

The economizer 26 further includes an inlet port 61*a*, a liquid outlet port 61*b*, and a gas outlet port 61*c*. The inlet port 61*a* is provided to introduce the two-phase refrigerant from the condenser 24 into the economizer 26. The liquid outlet port 61*b* is provided to discharge the liquid refrigerant separated from the two-phase refrigerant to the evaporator 28. The gas outlet port 61*c* is provided to discharge the gas refrigerant separated from the two-phase refrigerant to the economizer 26. The flow rate of the refrigerant flowing into the inlet port 61*a* is controlled by the expansion valve 25 which is disposed between the condenser 24 and the economizer 26. In accordance with the present invention, the expansion valve 25 is disposed away from the economizer 26. This provides more accurately established pressures to monitor for maintaining the liquid height. Also, subcooled liquid remains as liquid all the way to the expansion valve 25, which reduces the pipe size, and more sub cooling is provided by the pressure increase.

Figure 5:
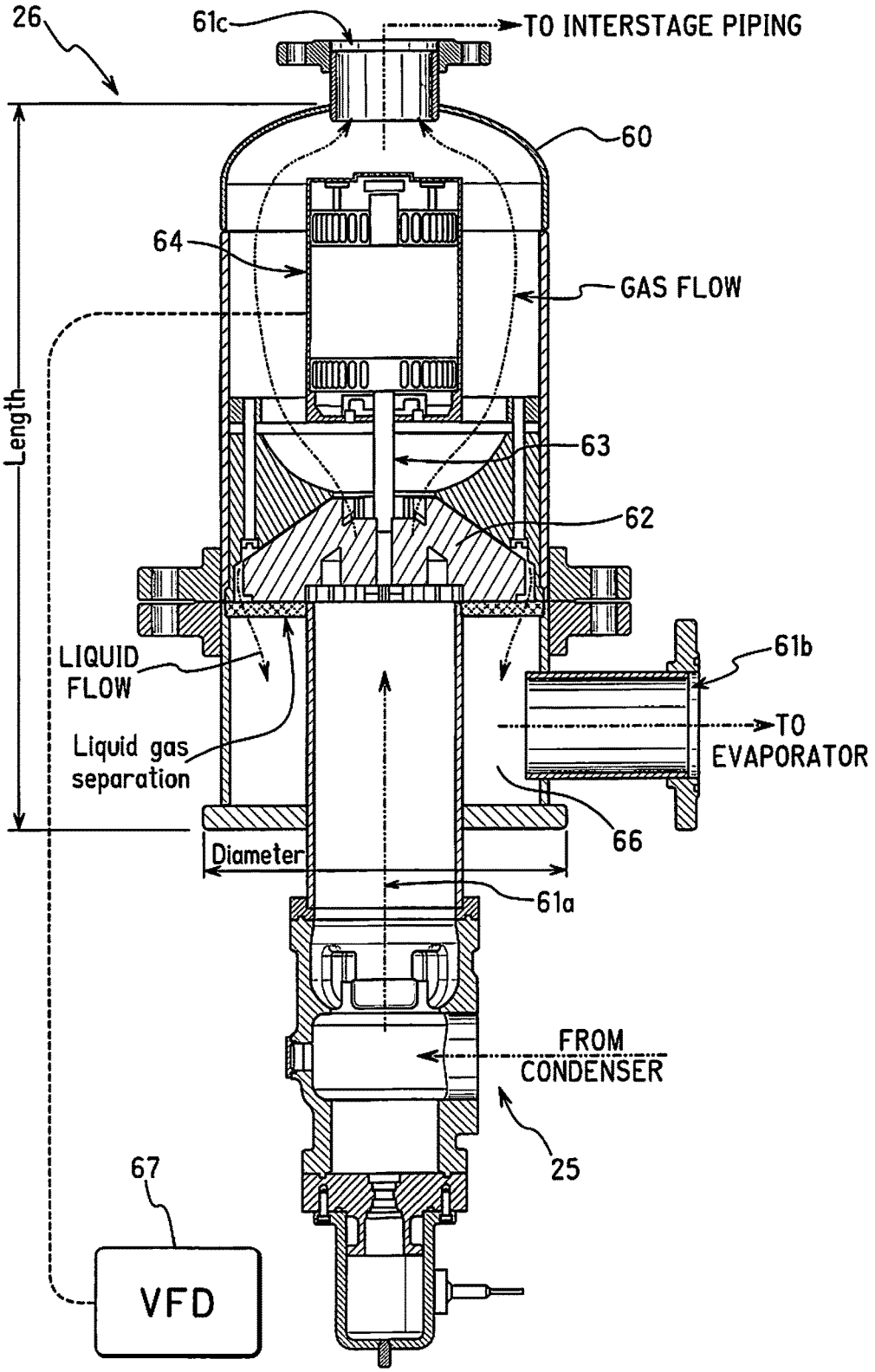
FIG. 5 is a longitudinal cross-sectional view of the economizer of the chiller system illustrated in FIG. 1 in which the motor is disposed inside the economizer.
Figure 6:
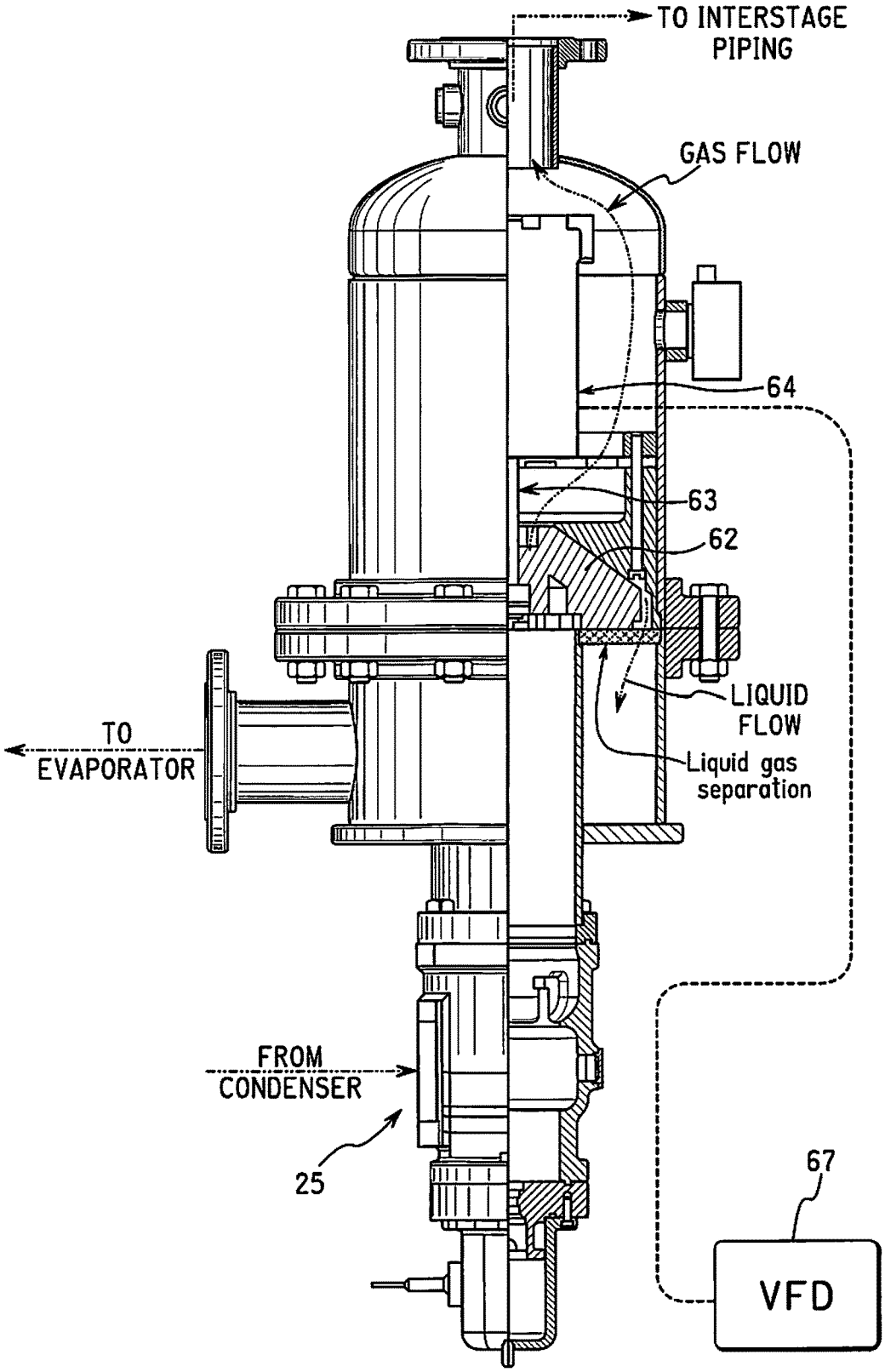
FIG. 6 is a side view of the economizer illustrated in FIG. 5 in which the motor is disposed inside the economizer, with portions broken away and shown in cross-section for the purpose of illustration.
Figure 7:
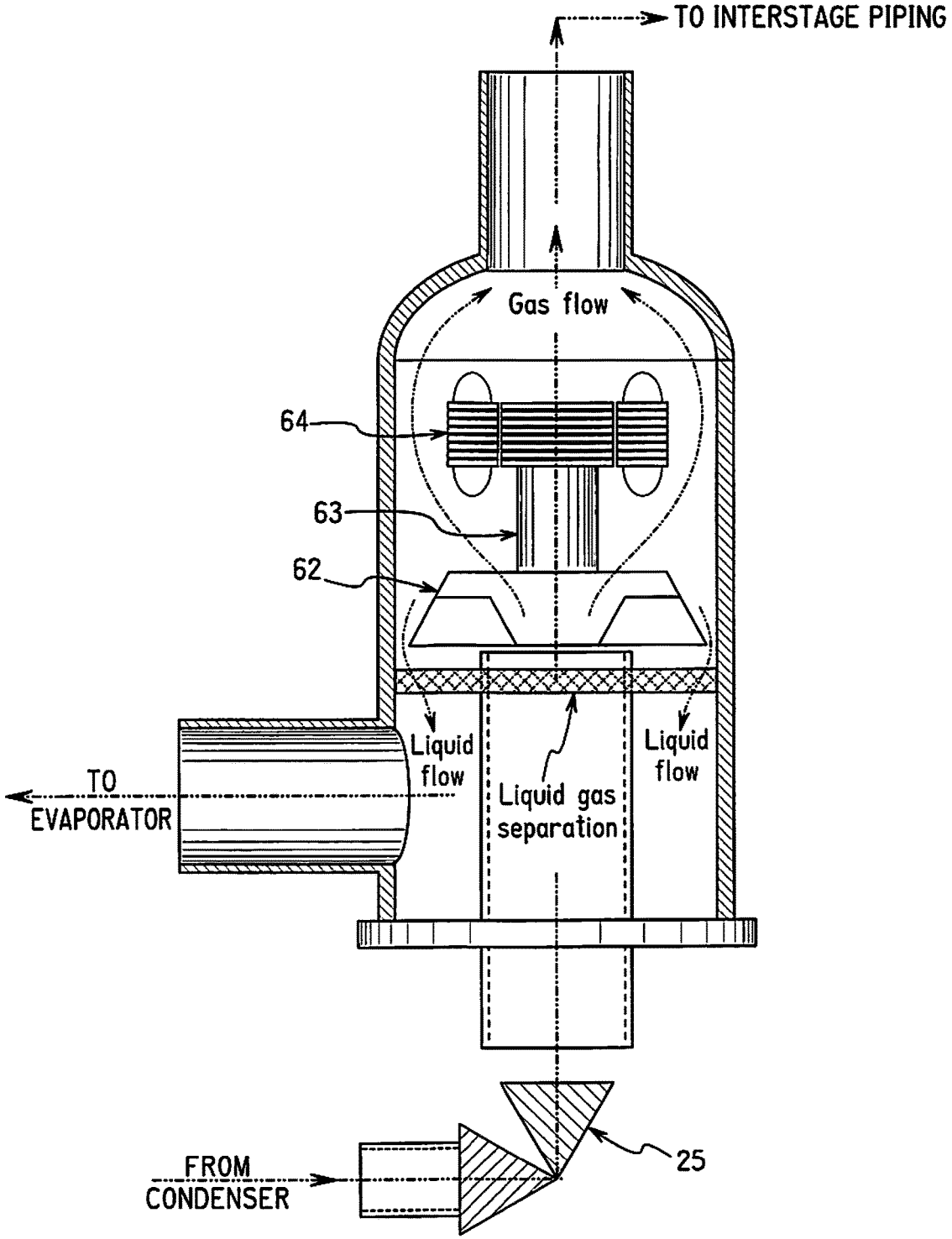
FIG. 7 is a schematic longitudinal cross-sectional view of the economizer illustrated in FIG. 5 in which the motor is disposed inside the economizer.
Figure 8:
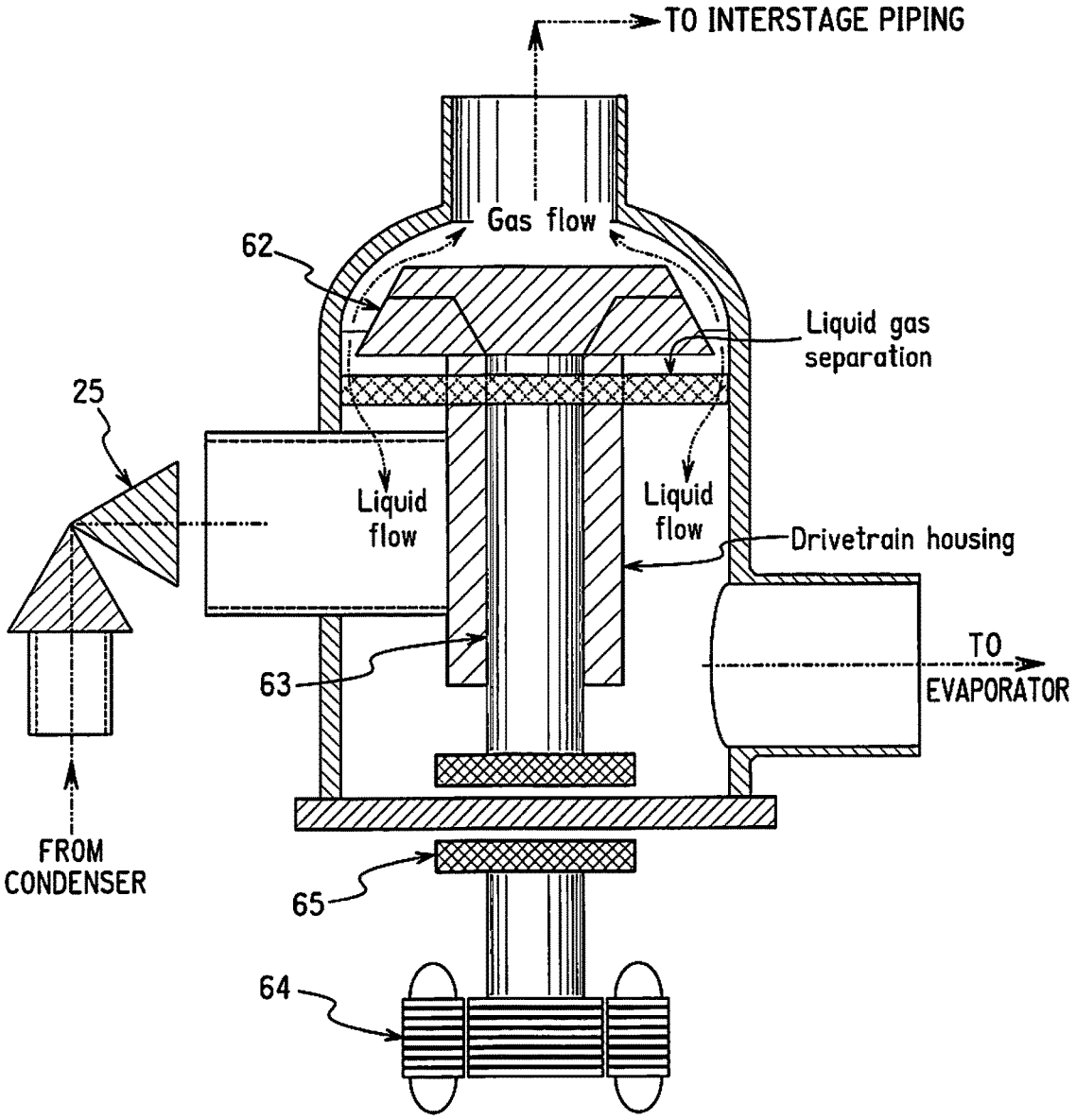
FIG. 8 is a schematic longitudinal cross-sectional view of the economizer in which the motor is disposed outside the economizer.

In the embodiment illustrated in FIGS. 5-7, the economizer motor 64 is disposed inside the economizer 26. However, the economizer motor 64 can be disposed outside the economizer 26 as illustrated in FIG. 8. In a case in which the economizer motor 64 is disposed outside the economizer 26, the economizer motor 64 is coupled to the separation wheel 62 by a magnetic coupling 65. In this manner, the economizer motor 64 rotates the economizer shaft 63 through the magnetic coupling 65 and rotates the separation wheel 62.

In operation, the refrigerant cooled to condense in the condenser 24 is decompressed to an intermediate pressure by the expansion valve 25, and is then introduced into the economizer 26. The two-phase refrigerant introduced from the inlet port 61*a* into the economizer 26 is separated into gas refrigerant and liquid refrigerant in the separation wheel 62 by dynamic force. The gas refrigerant is injected from the gas outlet port 61*c* of the economizer 26 into the intermediate stage of the compressor 22 via a pipe. The liquid refrigerant is guided from the liquid outlet port 61*b* to the evaporator 28, or is stored in the liquid storage portion 66.

The gas refrigerant injected into the intermediate stage of the compressor 22 is then mixed with the refrigerant of intermediate pressure compressed by the first stage impeller 34*a* of the compressor 22. The mixed refrigerant flows to the second stage impeller 34*b* to be further compressed.

Figure 4:
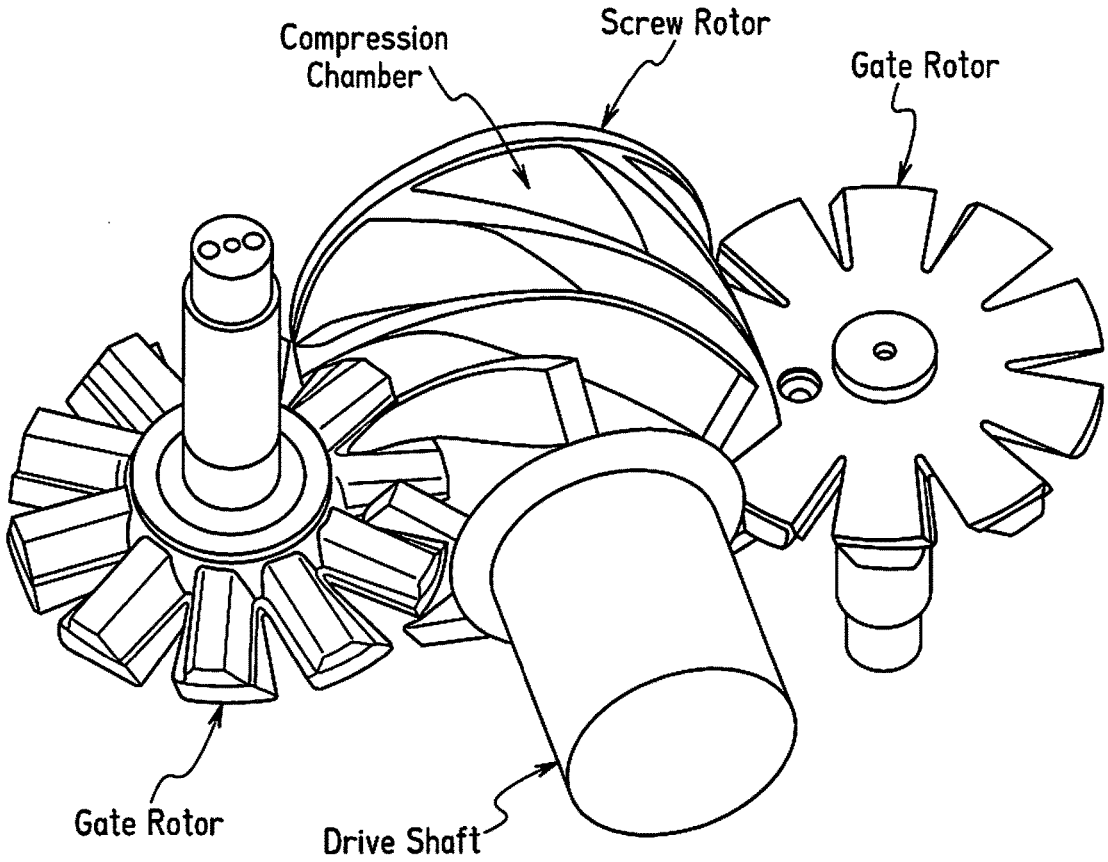
FIG. 4 is a perspective view of a screw compressor.

The compressor 22 can be a screw compressor as shown in FIG. 4. The screw compressor includes a screw rotor, a drive shaft inserted into the screw rotor to drive the screw rotor, and gate rotors which mesh with the screw rotor. The screw compressor shown in FIG. 4 is referred to as a single-rotor type. Alternatively, the compressor 22 can be a twin-rotor type or a tri-rotor type. In a case of the screw compressor, the gas refrigerant from the economizer 26 is injected into the center of the screw rotor.

Figure 12:
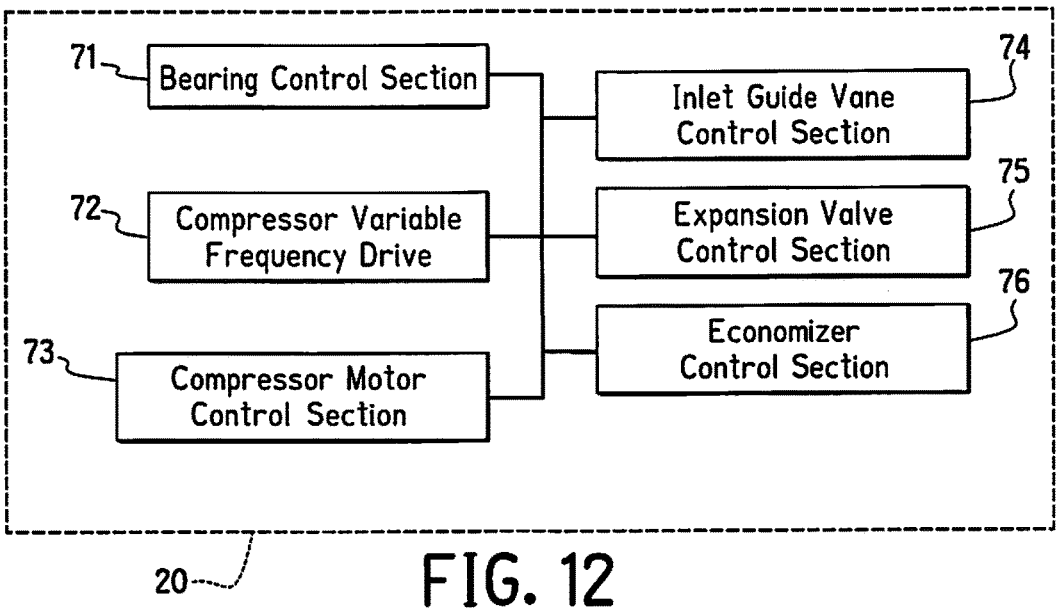
FIG. 12 is a schematic diagram of the controller of the chiller system of FIG. 1.

Referring to FIGS. 1 and 12, the chiller controller 20 includes a magnetic bearing control section 71, a compressor variable frequency drive 72, a compressor motor control section 73, an inlet guide vane control section 74, an expansion valve control section 75, and an economizer control section 76. In the illustrated embodiment, the economizer control section 76 is part of the chiller controller 20. However, the chiller controller 20 and the economizer control section 76 can be separate controllers or can be a single controller. Also, the compressor variable frequency drive 72 and the compressor motor control section 73 can be a single section.

In the illustrated embodiment, the control sections are sections of the chiller controller 20 programmed to execute the control of the parts described herein. The magnetic bearing control section 71, the compressor variable frequency drive 72, the compressor motor control section 73, the inlet guide vane control section 74, the expansion valve control section 75, and the economizer control section 76 are coupled to each other, and form parts of a centrifugal compressor control portion that is electrically coupled to an 1/O interface of the compressor 22. However, it will be apparent to those skilled in the art from this disclosure that the precise number, location and/or structure of the control sections, portions and/or chiller controller 20 can be changed without departing from the present invention so long as the one or more controllers are programmed to execute control of the parts of the chiller system 10 as explained herein.

The economizer control section 76 is connected to the economizer variable frequency drive 67 of the economizer 26 and communicates with various sections of the chiller controller 20. In this manner, the economizer control section 76 can receive signals from the sensors of the compressor 22, perform calculations, and transmit control signals to the economizer variable frequency drive 67 of the economizer 26.

The chiller controller 20 is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the chiller system 10. The chiller controller 20 may optionally include an input interface such as a keypad to receive inputs from a user and a display device used to display various parameters to a user. The parts and programming are conventional, except as related to controlling the economizer 26, and thus, will not be discussed in detail herein, except as needed to understand the embodiment(s).

Figure 9A:
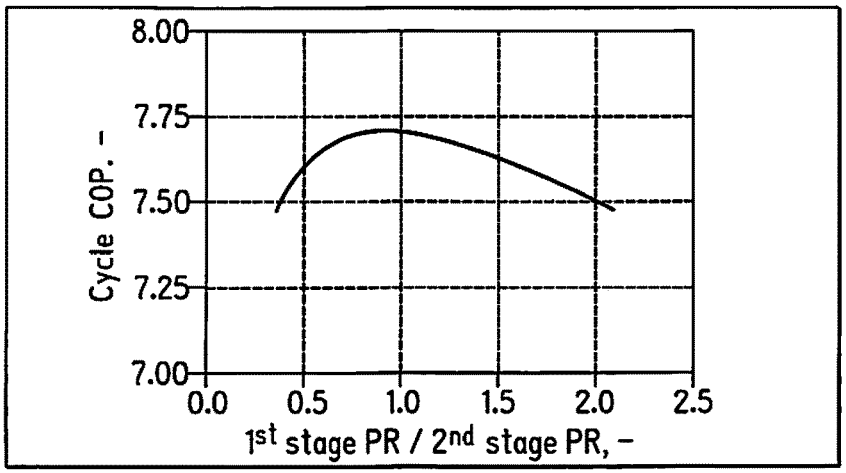
FIGS. 9A-9C are graphs illustrating the relationship between the coefficient of performance (COP) and the ratio of the first stage compression ratio and the second stage compression ratio.
Figure 9B:
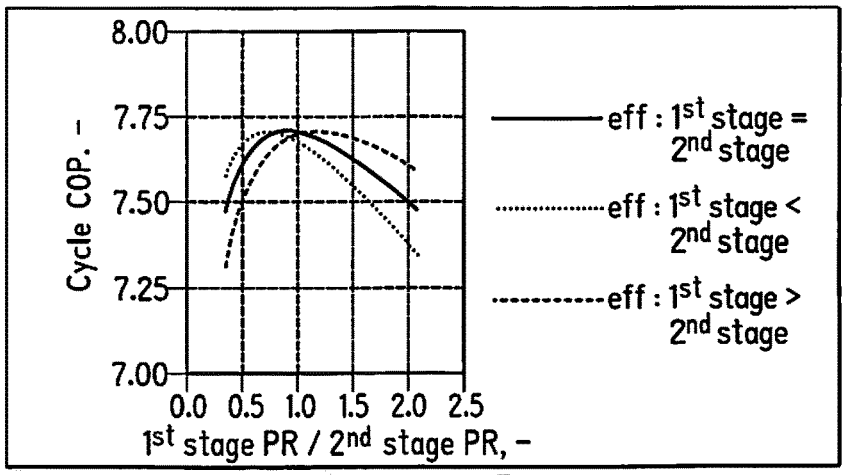
Figure 9C:
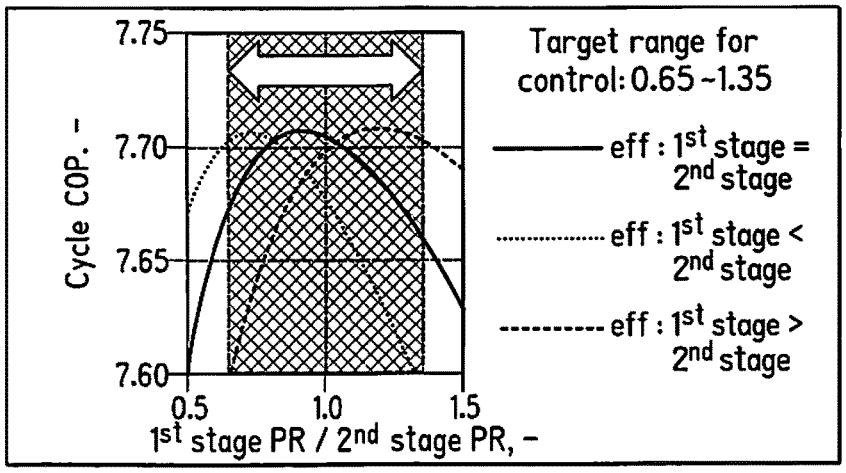

Referring to FIGS. 9A-9C, the ratio of the first stage compression ratio and the second stage compression ratio will affect the coefficient of performance (COP) of the compressor. FIG. 9A shows a case in which the isentropic efficiency of the first stage of the compressor is the same as the isentropic efficiency of the second stage of the compressor. FIGS. 9B and 9C show a case in which the isentropic efficiency of the first stage of the compressor is different from the isentropic efficiency of the second stage of the compressor.

As shown in FIG. 9A, in a case in which the isentropic efficiency of the first stage of the compressor is the same as the isentropic efficiency of the second stage of the compressor, the coefficient of performance (COP) will be at a maximum when the ratio of the first stage compression ratio and the second stage compression ratio is around 1.0. However, the isentropic efficiency of the first stage of the compressor is usually not the same as the isentropic efficiency of the second stage of the compressor. Therefore, even if the compressor is operated so that the ratio of the first stage compression ratio and the second stage compression ratio is 1.0, the coefficient of performance (COP) of the compressor will not be at a maximum.

As shown in FIG. 9B, in a case in which the isentropic efficiency of the first stage of the compressor is different from the isentropic efficiency of the second stage of the compressor, the peak of the coefficient of performance (COP) will vary depending on the ratio of the first stage compression ratio and the second stage compression ratio. When the isentropic efficiency of the first stage of the compressor is smaller than the isentropic efficiency of the second stage of the compressor, the peak of the coefficient of performance (COP) will be shifted to the left in FIG. 9B. In the illustrated embodiment, the peak of the coefficient of performance (COP) will be achieved when the ratio of the first stage compression ratio and the second stage compression ratio is around 0.65 . On the other hand, when the isentropic efficiency of the first stage of the compressor is greater than the isentropic efficiency of the second stage of the compressor, the peak of the coefficient of performance (COP) will be shifted to the right in FIG. 9B. In the illustrated embodiment, the peak of the coefficient of performance (COP) will be achieved when the ratio of the first stage compression ratio and the second stage compression ratio is around 1.35.

FIG. 9C is a graph in which the vicinity of the peak of the coefficient of performance (COP) shown in FIG. 9B is enlarged. As shown in FIG. 9C, the target range of controlling the ratio of the first stage compression ratio and the second stage compression ratio is between 0.65 and 1.35.

Figure 10:
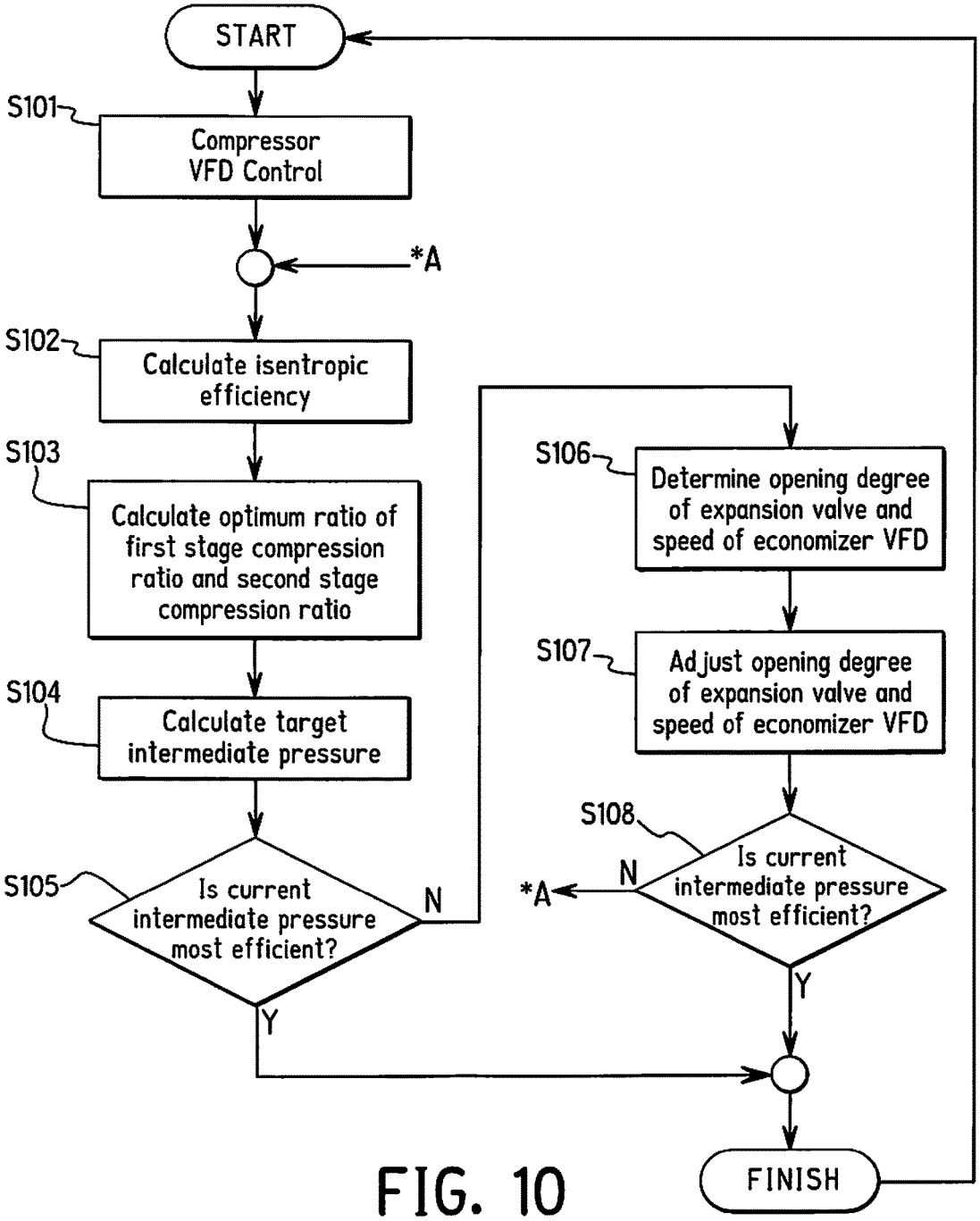
FIG. 10 is a flow chart illustrating a method of controlling the chiller system using the economizer.

Referring to FIG. 10, a method of controlling the chiller system 10 using the economizer 26 will now be explained in more detail.

As mentioned above, the economizer 26 is provided in the chiller system 10 to inject gas refrigerant into the intermediate stage of the compressor 22. In the illustrated embodiment, the compressor 22 is a two-stage centrifugal compressor. The compressor variable frequency drive 72 of the chiller controller 20 is programmed to control the compressor 22 (S101). The compressor variable frequency drive 72 is programmed to control the compressor 22 in a conventional manner such as disclosed in U.S. Patent Application Publication No. 2014/0260385 and U.S. Patent Application Publication No. 2014/0260388.

In S102, the economizer control section 76 calculates the isentropic efficiency of the first stage of the compressor 22 and the isentropic efficiency of the second stage of the compressor 22 from the current operation status. Next, in S103, the economizer control section 76 calculates an optimum ratio of the first stage compression ratio and the second stage compression ratio of the compressor 22. As discussed above, the peak of the coefficient of performance (COP) of the compressor 22 will be achieved when the ratio of the first stage compression ratio and the second stage compression ratio is optimum.

Next, in S104, the economizer control section 76 calculates a target intermediate pressure of the compressor 22 based on the optimum ratio of the first stage compression ratio and the second stage compression ratio.

In S105, the economizer control section 76 determines whether or not the current intermediate pressure of the compressor 22 is the most efficient, i.e., the current intermediate pressure of the compressor 22 is the target intermediate pressure of the compressor 22 which is calculated in S104. When the economizer control section 76 determines that the current intermediate pressure of the compressor 22 is the most efficient (Yes in S105), the controlling method will be finished. When the economizer control section 76 determines that the current intermediate pressure of the compressor 22 is not the most efficient (No in S105), the economizer control section 76 will proceed to S106.

In S106, the economizer control section 76 determines the opening degree of the expansion valve 25 and the speed of the economizer variable frequency drive 67 to achieve the target intermediate pressure of the compressor 22. In S107, the economizer control section 76 adjusts the opening degree of the expansion valve 25 and the speed of the economizer variable frequency drive 67 to achieve the target intermediate pressure of the compressor 22. In this manner, the flow rate of the refrigerant flowing into the inlet port 61*a* is controlled by the expansion valve 25 and the rotational speed of the separation wheel 62 of the economizer 26 is controlled by the economizer variable frequency drive 67 so as to achieve the target intermediate pressure of the compressor 22.

In S108, the economizer control section 76 determines whether or not the current intermediate pressure of the compressor 22 is the most efficient, i.e., the current intermediate pressure of the compressor 22 is the target intermediate pressure of the compressor 22. When the economizer control section 76 determines that the current intermediate pressure of the compressor 22 is the most efficient (Yes in S108), the controlling method will be finished. When the economizer control section 76 determines that the current intermediate pressure of the compressor 22 is not the most efficient (No in S108), the economizer control section 76 will go back to S102, and the controlling method will be repeated. For example, the above-mentioned processes can be repeated when at least one of the followings occurs: the speed of the compressor variable frequency drive 72 varies with 10% per minute or more, the discharge pressure of the compressor 22 varies with 10% per minute or more, and the suction pressure of the compressor 22 varies with 10% per minute or more.

Figure 11:
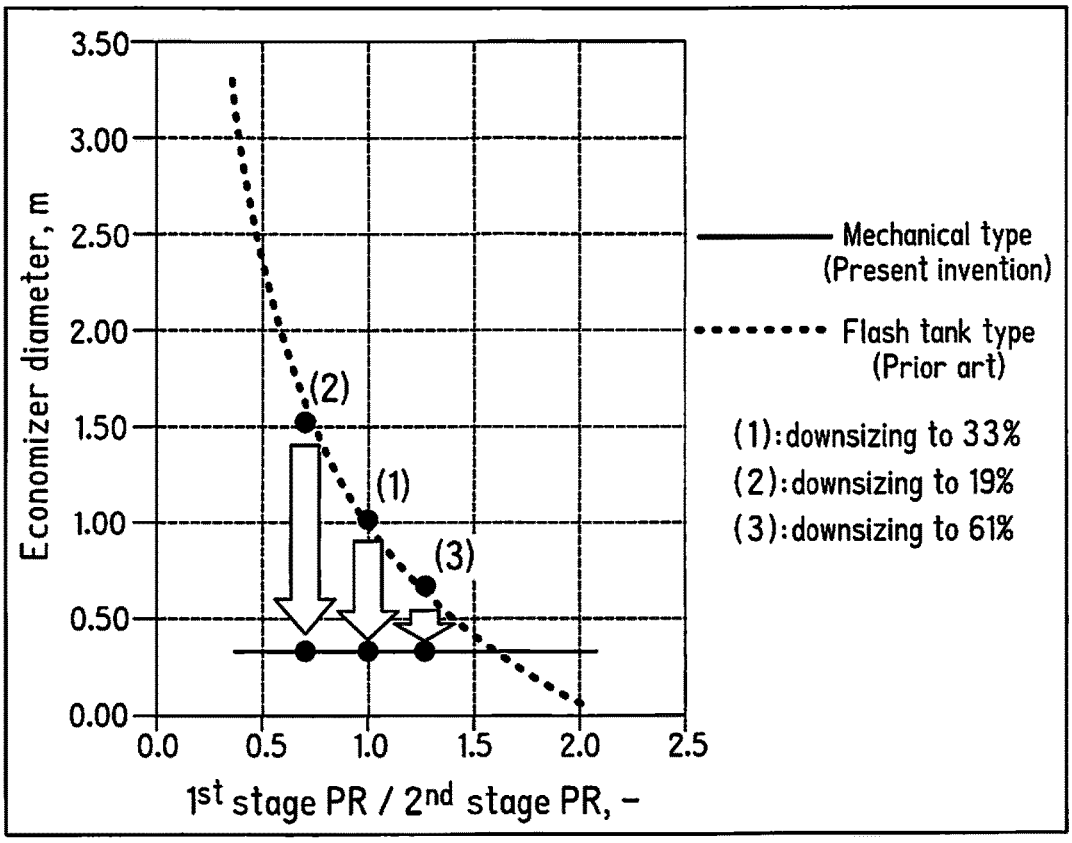
FIG. 11 is a graph illustrating the relationship between the economizer size and the ratio of the first stage compression ratio and the second stage compression ratio.

FIG. 11 is a graph illustrating the relationship between the size of the economizer 26 and the ratio of the first stage compression ratio and the second stage compression ratio of the compressor 22.

Referring to FIG. 11, the economizer 26 in the illustrated embodiment has advantages in downsizing of the diameter of economizer 26. The solid line in FIG. 11 shows the diameter of the economizer 26. The dotted line in FIG. 11 shows the diameter of a conventional flash tank economizer. In a case in which the ratio of the first stage compression ratio and the second stage compression ratio is not controlled to be optimum, i.e., the ratio of the first stage compression ratio and the second stage compression ratio is 1.0, a conventional flash tank economizer requires a diameter of at least 0.99 m because the conventional flash tank economizer performs gas-liquid separation by gravity. In contrast, the diameter of the economizer 26 in the illustrated embodiment can be reduced by using the separation wheel 62 which performs gas-liquid separation by dynamic force. Namely, even in a case in which the ratio of the first stage compression ratio and the second stage compression ratio is not controlled to be optimum, the diameter of the economizer 26 is 0.33 m, which achieves downsizing to an approximate 33% diameter. See case (1) of FIG. 11.

In a case in which the ratio of the first stage compression ratio and the second stage compression ratio is controlled to be 0.65, the conventional flash tank economizer requires a diameter of 1.77 m because the flow rate to be processed increases. On the other hand, the diameter of the economizer 26 can be maintained at 0.33 m by increasing the speed of the separation wheel 62. Accordingly, downsizing to an approximate 19% diameter can be achieved. See case (2) of FIG. 11.

In a case in which the ratio of the first stage compression ratio and the second stage compression ratio is controlled to be 1.35, the conventional flash tank economizer requires a diameter of 0.54 m. On the other hand, the diameter of the economizer 26 can be maintained at 0.33 m. Accordingly, downsizing to an approximate 61% diameter can be achieved. See case (3) of FIG. 11. In this manner, the economizer 26 in accordance with the present invention has advantages in downsizing of the diameter of economizer 26. Also, a less volume of refrigerant is required for the chiller system 10 using the economizer 26 in accordance with the present invention.

In terms of global environment protection, use of new low GWP (Global Warming Potential) refrigerants such like R1233zd, R1234ze are considered for chiller systems. One example of the low global warming potential refrigerant is low pressure refrigerant in which the evaporation pressure is equal to or less than the atmospheric pressure. For example, low pressure refrigerant R1233zd is a candidate for centrifugal chiller applications because it is non-flammable, non-toxic, low cost, and has a high COP compared to other candidates such like R1234ze, which are current major refrigerant R134a alternatives. Especially in a case of using low pressure refrigerant, the economizer in accordance with the present invention has advantages because the economizer in accordance with the present invention achieves downsizing of the diameter thereof. Also, various kinds of low pressure refrigerants can be used for the economizer in accordance with the present invention for gas-liquid separation.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An economizer adapted to be used in a chiller system including a compressor having a compressor motor, an evaporator and a condenser, the economizer comprising:

a separation wheel arranged and configured to separate refrigerant into gas refrigerant and liquid refrigerant, the separation wheel being attached to a shaft rotatable about a rotation axis;

an economizer motor arranged and configured to rotate the shaft in order to rotate the separation wheel;

a liquid storage portion arranged and configured to store the liquid refrigerant;

a variable frequency drive arranged and configured to control the economizer motor in order to adjust a rotational speed of the separation wheel; and a controller programmed to control the variable frequency drive, the economizer being connected to an intermediate stage of the compressor such that the refrigerant is injected into the intermediate stage of the compressor, and the controller being further programmed to control the variable frequency drive such that the economizer achieves a target intermediate pressure of the compressor.

2. The economizer according to claim 1, wherein the economizer motor is disposed inside the economizer.

3. The economizer according to claim 1, wherein
the economizer motor is disposed outside the economizer.

4. The economizer according to claim 3, wherein
the economizer motor is coupled to the separation wheel by magnetic coupling.

5. The economizer according to claim 1, wherein
the separation wheel is further configured to separate the refrigerant by dynamic force.

6. A chiller system comprising a compressor and the economizer according to claim 1, wherein
the compressor is a multi-stage compressor.

7. The chiller system according to claim 6, wherein
the compressor is a centrifugal compressor.

8. The chiller system according to claim 7, wherein
the controller is further programmed to calculate the target intermediate pressure of the compressor from an optimum ratio between a compression ratio in a first stage of the compressor and a compression ratio in a second stage of the compressor based on an operation state of the compressor.

9. A chiller system comprising a compressor and the economizer according to claim 1, wherein
the compressor is a screw compressor.

10. The economizer according to claim 1, wherein
the refrigerant is low pressure refrigerant in which an evaporation pressure is equal to or less than an atmospheric pressure.

11. The economizer according to claim 10, wherein
the low pressure refrigerant includes R 1233 zd.

12. A chiller system including the economizer according to claim 1, the chiller system further comprising:
a compressor, an evaporator, and a condenser.

13. The chiller system according to claim 12, wherein
the economizer is disposed between the evaporator and the condenser in the chiller system.

14. The chiller system according to claim 12, further comprising
a valve regulating a flow of refrigerant into the economizer,
the controller being further programmed to control the valve such that the economizer achieves the target intermediate pressure of the compressor and the economizer increases a pressure of the liquid refrigerant flowing to the evaporator.

* * * * *